United States Patent [19]

Cook et al.

[11] Patent Number: 5,008,030

[45] Date of Patent: Apr. 16, 1991

[54] ACIDIC DISINFECTANT ALL-PURPOSE LIQUID CLEANING COMPOSITION

[75] Inventors: William J. Cook, New York, N.Y.; Karen L. Wisniewski, Bound Brook; Nagaraj S. Dixit, Plainsboro, both of N.J.; Nandakumar S. Rao, Hockessin, Del.

[73] Assignee: Colgate-Palmolive Co., Piscataway, N.J.

[21] Appl. No.: 297,807

[22] Filed: Jan. 17, 1989

[51] Int. Cl.[5] ..... C11D 3/48; C11D 7/08

[52] U.S. Cl. ..... 252/106; 252/142; 252/174.22; 252/174.24; 252/174.19; 252/174.23; 252/DIG. 14

[58] Field of Search ..... 252/106, 142, 174.19, 252/174.22, 174.21, 174.23, DIG. 2, DIG. 14, 174.24

[56] References Cited

U.S. PATENT DOCUMENTS

| | | | |
|---|---|---|---|
| 3,223,643 | 12/1965 | Law | 252/106 |
| 3,650,965 | 3/1972 | Cantor et al. | 252/106 |
| 3,836,669 | 9/1974 | Dadekian | 424/329 |
| 4,058,473 | 11/1977 | Canter | 252/121 |
| 4,311,608 | 1/1982 | Maurice | 252/143 |
| 4,392,477 | 7/1983 | Altenscl ‘er et al. | 252/174.19 |
| 4,528,110 | 7/1985 | Bragulla | 252/106 |
| 4,581,161 | 4/1986 | Nedonchelle | 252/550 |
| 4,597,887 | 7/1986 | Colodney et al. | 252/106 |
| 4,608,086 | 8/1986 | Dodge | 252/142 |
| 4,612,135 | 9/1986 | Wenzel | 252/106 |
| 4,715,980 | 12/1987 | Lopes et al. | 252/106 |
| 4,725,319 | 2/1988 | Osberghaus | 134/4 |
| 4,828,750 | 5/1989 | Simion et al. | 252/142 |

FOREIGN PATENT DOCUMENTS

| | | |
|---|---|---|
| 540798 | 5/1957 | Canada . |
| 21205 | 2/1978 | Japan . |

OTHER PUBLICATIONS

Kubitschek, H. E., "Hard Surface Cleaners–II. Performance Normal and Blended Neodol Mixtures", Shell Development Co., Jul. 1979.

*Primary Examiner*—Prince E. Willis

*Attorney, Agent, or Firm*—Bernard Lieberman; Murray M. Grill; Robert C. Sullivan

[57] ABSTRACT

A stable, acidic disinfectant all-purpose liquid cleaning composition, free of detergent builders and substantially free of organic solvents, comprising a mixture of acid stable water-soluble and water-dispersible nonionic surfactants, organic acid and a water soluble, acid stable disinfectant compound in an aqueous medium. The composition spreads quickly and provides good detergency with efficient penetration of soils while maintaining a high level of disinfectant activity. A soil releasing agent may also be included in the composition in order to provide easier cleaning of the treated surface during subsequent cleaning operations. The composition is particularly effective for cleaning soap scum and mineral deposits from hard surfaces such as grout, ceramic tile, stainless steel and glass.

20 Claims, No Drawings

ACIDIC DISINFECTANT ALL-PURPOSE LIQUID CLEANING COMPOSITION

FIELD OF THE INVENTION

The present invention relates to the formulation of a stable, acidic disinfectant all-purpose liquid cleaning compositions for use on hard surfaces. The compositions are effective in removing soap scum, fatty deposits and mineral deposits while simultaneously disinfecting the hard surfaces being cleaned. Cleaning is provided by incorporation of a lower alkyl mono and/or dicarboxylic organic acid and an acid-stable nonionic surfactant system consisting essentially of an acid stable water-soluble nonionic surfactant and an acid stable water-dispersible nonionic surfactant. The pH of the composition is about 2–4 and preferably 2.5–3.0. Disinfecting properties are provided by incorporation of an acid-stable, water soluble disinfectant compound such as a germicidal quaternary ammonium compound, chlorhexidine or glutaraldehyde. A cationic or anionic soil-releasing agent which is substantive to the cleaned surfaces is preferably included in the compositions of the invention to facilitate removal of soils such as soap scum during subsequent cleanings of the surface.

BACKGROUND OF THE INVENTION

The prior art is replete with liquid all purpose hard surface cleaning compositions which are generally comprised of two types. The first type is a particulate aqueous suspension having water-insoluble abrasive particles suspended therein, which particles are palpable. Some of the cleaners of this type suffer a stability problem while others have received poor acceptance by consumers because of their "gritty" feel which causes many people to be reluctant to use them for fear of scratching the surface to be cleaned. The second type is the liquid detergent without suspended abrasive and this latter type is often preferred by consumers. While the liquid hard surface cleaner without abrasives is generally a mixture of a surfactant and builder salt in an aqueous medium, the product formulations in the market place have varied widely in composition.

The presence of builder salts as an essential ingredient in all purpose hard surface cleaning compositions to improve cleaning and to maintain an alkaline pH range, is disclosed in U.S. Pat. Nos. 4,576,738 and 4,597,887, and in European Patent Application Nos. 0165885 and 0080749 and in UK Patent Application No. 2166153A.

However, these prior art all-purpose liquid detergents containing detergent builder salts or other equivalents tend to leave films, spots or streaks on cleaned unrinsed surfaces, particularly shiny surfaces such as glass or stainless steel. Thus, such liquids require thorough rinsing of the cleaned surfaces which is a time-consuming chore for the user.

In order to overcome the problem of rinsing associated with the prior art all-purpose liquids, U.S. Pat. No. 4,017,409 teaches that paraffin sulfonate with a reduced concentration of inorganic phosphate builder salt may be employed. However, such compositions are often unacceptable from an environmental point of view based upon the phosphate content. Phosphate-free all-purpose liquids have been disclosed which contain a major proportion of a mixture of anionic and nonionic detergents with minor amounts of glycol ether solvent and organic amine as shown in U.S. Pat. No. 3,935,130. This approach has not been completely satisfactory due to excessive foaming from the high levels of organic detergents necessary to achieve cleaning and due to deposition of soap residue on the cleaned surfaces, leading to residual streaks and spots.

In order to overcome the disadvantages associated with the builder salts, Japanese Patent Kokai No. 52-77111 and European Patent Application No. 0,151,517 have used organic acids to improve detergency of builder-free detergent compositions. These compositions also contain an organic solvent as an essential ingredient which functions to dissolve greasy soil and soap scum, i.e., to improve detergency. Japanese Patent No. 52-77111 uses one or more organic acids selected from the group consisting of glycolic acid, lactic acid, citric acid, malic acid and malonic acid. European Patent Application No. 0,151,517 uses at least one water-soluble dicarboxylic acid having a 5–7 carbon chain length, which includes glutaric, adipic and pimelic acids.

The inclusion of a grease-removing organic solvent in an all purpose liquid cleaner composition for the degreasing of hard surfaces, is also disclosed in the above cited patents as well as others. Cleaning compositions containing a high boiling water-miscible organic solvent such as propylene glycol or ethylene glycol-monobutyl ether are disclosed in GB Patent No. 2166153A; a binary solvent system of Pinane and an ethylene glycol—or propylene glycol—monoethyl or monobutyl ether is disclosed in U.S. Pat. Nos. 4,576,738 and 4,597,887; a dual solvent system of dipropylene glycol methyl ether and mineral spirits is disclosed in U.S. Pat. No. 4,673,524; and a propylene glycol monomethyl ether and/or dipropylene glycol monomethyl ether as a penetrant to penetrate road film is disclosed in U.S. Pat. No. 4,670,171.

The prior art also discloses acidic liquid cleaning compositions containing organic solvents. A microemulsion-based acid composition containing phosphoric ester surfactants, hydrocarbon solvents and phosphoric acid for use as an all-purpose metal surface cleaner is disclosed in U.S. Pat. No. 4,540,448. U.S. Pat. No. 4,501,680 discloses an acidic liquid detergent for cleaning ceramic tiles without eroding the grout between the tiles. This composition contains two acids (i.e., glutaric acid and phosphoric acid), a nonionic surfactant, and an organic solvent.

However, none of the above-cited prior art, including the acidic all purpose cleaners, provides cleaning compositions which simultaneously disinfect the hard surfaces being cleaned.

However, non-acidic disinfectant compositions containing the combination of a quaternary ammonium germicidal compound and a nonylphenolethylene oxide condensate in an aqueous solution are disclosed in U.S. Pat. No. 3,017,278 for use in sterilizing medical and dental instruments and in U.S. Pat. No. 3,052,604 for direct application to human and animal tissue surfaces to promote wound healing.

Also, U.S. Pat. No. 3,223,643 discloses a liquid acid detergent-sanitizer composition of pH 2.5–3.5 containing phosphoric acid, a $C_8$–$C_{18}$ alkyl dimethyl benzyl ammonium chloride sanitizer, and an alkylaryl polyether alcohol having about 5 to 7.5 ethylene oxide units. The nonionic detergent and the quaternary ammonium compound are in a 1:1 ratio in the disclosed compositions.

U.S. Pat. No. 4,661,523 discloses a concentrated acidic disinfectant composition having a pH of 3.5–4 which contains a synergistic bactericidal mixture of aldehydes and a quaternary ammonium compound, phosphonocarboxylic acid, and an amino-polycarboxylic acid salt, in an aqueous or aqueous-organic solvent vehicle.

German Patent Appln. No. 3445901 discloses a disinfectant agent concentrate in an aqueous or aqueous-organic solvent medium containing a synergistic mixture of hydrogen peroxide, a quaternary ammonium compound, a biguanide as the antimicrobial disinfectant agent, a complexing agent such as alkane poly-phosphonic acids and salts thereof to stabilize the hydrogen peroxide, an acid such as boric acid or phosphoric acid in an amount to provide a pH of 3–7 and optionally a nonionic and/or amphoteric surfactant.

U.S. Pat. No. 3,223,643, U.S. Pat. No. 4,661,523 and German Patent Appln. No. 3445901 are all acidic disinfecting cleaners. However, all of these prior art compositions incorporate phosphate acids and consequently have associated problems concerning environmental safety.

None of the above-mentioned disinfectant cleaning compositions provide a stable acidic disinfectant all-purpose liquid cleaning composition with improved removal of soap scum in the absence of detergent builders, organic solvents and phosphate compounds. In addition, unlike the cleaning compositions of the present invention, the prior art compositions are unable to provide a cleaned surface such that the removal of soil during subsequent cleanings is significantly enhanced.

SUMMARY OF THE INVENTION

It has been found that a stable homogenous, acidic disinfectant all-purpose liquid cleaning composition having improved cleaning and disinfecting properties with minimal damage to hard surfaces can be prepared in accordance with the present invention in the absence of a builder salt and an organic solvent. The compositions comprise (a) from about 0.5–4% by weight of a nonionic surfactant system containing a mixture of an acid stable water soluble nonionic surfactant and an acid stable water dispersible nonionic surfactant in approximately a 4:1 to 4:3 ratio by weight of soluble to dispersible surfactant; (b) at least 0.1% by weight of an acid stable disinfectant compound; (c) about 3–7% by weight of an organic acid selected from the group consisting of a lower aliphatic monocarboxylic acid, dicarboxylic acid and mixtures thereof, and; (d) optionally 0–2% of an acid stable cationic or anionic soil releasing agent, in an aqueous medium. The liquid cleaning compositions have a pH of approximately 2–4 and may be in the form of dilute solutions or dilute microemulsions. These acidic cleaning compositions are particularly suitable for cleaning hard surfaces such as plastic, vitreous and metal surfaces, and more specifically grout, stainless steel, glass and ceramic tile. The instant novel liquid cleaner penetrates soil efficiently, spreads quickly and disinfects with little or no damage to the hard surfaces being cleaned. The present compositions exhibit improved efficacy in removing soap scum and mineral deposits and, therefore, have particular utility in the cleaning of bathrooms and kitchens.

Accordingly, the primary object of the present invention is to provide an acidic disinfectant liquid cleaning composition which effectively disinfects and removes soils, particularly soap scum and mineral deposits, from hard surfaces without damaging the cleaned surface. An additional object of the invention is to provide said acidic disinfectant liquid cleaning composition also containing a surface soil releasing agent functional at acid pH to facilitate removal of soil during subsequent cleanings of the previously cleaned surface.

In a preferred embodiment of the invention, the liquid all purpose disinfectant cleaning compositions comprise, by weight, about 2–4% of a nonionic detergent system wherein the ratio of acid-stable water soluble nonionic surfactant to acid-stable water dispersible nonionic surfactant is about 3:1 to 3:2, at least 0.1% of a water soluble, acid stable germicidal or antimicrobial compound, about 3–5% of a lower aliphatic dicarboxylic acid mixture, about 0.25–1% of an acid stable cationic or anionic soil release treatment agent in an aqueous medium, said liquid cleaning composition having a pH of about 2.5–3.

DETAILED DESCRIPTION OF THE INVENTION

The acidic disinfectant liquid detergent compositions of the present invention are in the form of stable aqueous solutions or microemulsions. The compositions comprise water, an organic acid or a mixture of organic acids, a mixture of acid-stable water-soluble and water-dispersible nonionic surfactants and a water soluble, acid-stable germicidal or disinfectant compound. Optionally, a cationic or anionic soil releasing compound which is substantive to the surface being cleaned may be included in the composition in order to reduce subsequent adhesion of soil and provide easier recleaning of the treated surface. Additional minor ingredients commonly used in the preparation of cosmetically and commercially acceptable liquid detergent compositions may also be present in the composition of the present invention and will be obvious to those skilled in the art upon practicing the invention. These minor ingredients include, but are not limited to, acid stable perfumes and fragrances, compatible coloring agents, viscosifiers and the like.

The active detergent ingredient of the present all-purpose liquid detergent composition consists essentially of a mixture of acid-stable water soluble and water dispersible nonionic surfactants. The mixture of surfactants acts synergistically to provide rapid and efficient spreading of the detergent composition over the surface to be cleaned. The synergistic mixture of nonionic surfactants provides improved detergency against soils such as soap scum and mineral deposits when compared to commercially available acidic liquid hard surface cleaning products but with less damage to surfaces as compared with with the most acidic of such commercial products.

The nonionic surfactants useful in the present inventive compositions must be stable at the acid pH of the liquid detergent composition. They are generally the condensation product of an organic aliphatic or alkyl aromatic hydrophobic compound and hydrophilic ethylene oxide or propylene oxide groups. Hydrophobic compounds having a carboxy, hydroxy, or an amido group or an amino group with a free hydrogen can be condensed with ethylene oxide, polyethylene glycol or propylene oxide to form a nonionic detergent. The length of the polyetheneoxy or polypropeneoxy chain can be adjusted during the condensation reaction to achieve a desired ratio of hydrophobic and hydrophilic elements. The length of the hydrophilic (polar) chain relative to the length of the hydrophobic (nonpolar) component also determines the degree of solubility of the nonionic detergent in water, i.e. the degree of polarity.

The degree of solubility in water of nonionic surfactants is characterized and predicted in the art by the hydrophile/lipophile balance (HLB) of the surfactant molecule. Nonionic detergents which are more lipophilic, that is oil soluble, have low HLB numbers. These form dispersions when agitated in water. High HLB numbers correspond to increased water solubility of the nonionic detergent. For nonionic detergents, the HLB number is directly related to the relative molar ratio of ethylene oxide and/or propylene oxide to the alkyl chain of the molecule.

The most useful mixtures of nonionic surfactants for purposes of the invention are the acid stable condensation products of higher alcohols containing 8 to 20 carbon atoms in straight or branched chain configuration, preferably containing 8 to 14 carbon atoms.

The water soluble nonionic surfactant component of the surfactant mixture has a minimum HLB number of approximately 11 and forms a translucent to clear dispersion or a clear solution when mixed with water. Examples of water soluble nonionic surfactants useful in the present invention include, but are not limited to, $C_{9-11}$ alcohols condensed with 8 ethoxyethylene radicals (for example Neodol 91-8 available from Shell Oil Co) which have an HLB number of approximately 13.9 and $C_{9-11}$ alcohols condensed with 6 ethoxyethylene radicals (for example Neodol 91-6 available from Shell Oil Co.) with an HLB number of approximately 12.5. Other water soluble nonionic surfactants having HLB numbers of 11 or greater which are useful in the present invention are well known in the art, such as those nonionic surfactants which are the condensation products of an alkyl phenol with ethylene oxide (the nonyl phenols) or higher alcohols condensed with a combination of ethylene oxide and propylene oxide (the Pluronics) having a terminal ethoxylate group.

The water-dispersible nonionic surfactant component of the surfactant mixture of the present invention is characterized by an HLB number of about 7–10. These surfactants, being more lipophilic, form a milky dispersion when agitated in water. Examples of water-dispersible nonionic surfactants useful in the present invention include $C_9$–$C_{11}$ alkanol ethoxylates having 2.5 moles of ethylene oxide per mole of alcohol (for example Neodol 91-2.5 available from Shell Oil Co. having HLB=8.5). Additional examples of suitable water-dispersible nonionic surfactants and may be selected from such surfactant groups as the nonylphenols and the Pluronics as described above.

Nonionic surfactant mixtures are assayed for their synergistic properties in two assay systems. Spreading properties of the surfactant mixture are assessed on clean glass surfaces. Approximately 20 microliters of a surfactant mixture containing a total concentration of surfactant of less than 5% is placed as a droplet on a clean glass surface and allowed to sit undisturbed for approximately two minutes. At that time, the diameter of the surfactant drop is measured. A diameter of at least about 20 mm indicates a synergistic effect on surface spreading for the surfactant mixture. Under similar test conditions, a deionized water drop spreads to approximately 8 mm in diameter and surfactant solutions which do not exhibit enhanced spreading reach a maximum diameter of about 15 mm.

The soil cleaning or detergency properties of the nonionic surfactant mixtures are determined using the Roll-up test, in which 9 ml of the surfactant mixture to be tested is added to a vial containing approximately 10 microliters of oleic acid placed in the vial as a droplet. The amount of time required for the oleic acid droplet to rise to the surface of the liquid is measured. A colored dye may be added to the oleic acid for improved visibility. Decreasing roll-up time is indicative of increasing detergent efficacy, and effective detergents generally exhibit a roll-up time of 60 seconds or less. Effective acid-stable nonionic surfactant mixtures in accordance with the invention provide roll-up times of about 60 seconds or less when tested in this system. Within nonionic surfactant ratios of 3:1 to 3:2 by weight, roll-up times of about 30 seconds or less were obtained using Neodol 91-8 (water soluble) in combination with Neodol 91-2.5 (water dispersible) in an acidic aqueous medium. Samples consisting of Neodol 91-8 in combination with Neodol 91-2.5 also showed roll-up times of less than 60 seconds within the range of weight ratios of 4:1 to 4:3. These synergistic surfactant mixtures eliminate the need for grease-removing organic solvents such as are conventionally used in liquid hard surface cleaning compositions. The mixtures remain stable over a wide range of temperatures.

The liquid cleaner of the present invention cleans soap scum soil and removes mineral deposits through the action of both the nonionic surfactant system and, additionally, at least one organic acid selected from the group consisting of lower aliphatic monocarboxylic acids and dicarboxylic acids in an amount of about 3–7% by weight of the composition. Representative members of the aliphatic acids include $C_1$–$C_6$ alkyl and alkenyl monobasic acids and dibasic acids such as glutaric acid, succinic acid, propionic acid, adipic acid, hydroxyacetic acid and mixtures thereof. Glutaric acid is preferred, however, a mixture of the dibasic acids, adipic, glutaric and succinic acids is easily available commercially and is useful in the inventive compositions. The ratio of the acids in the foregoing mixture is adjusted to maximize water solubility of the mixture by employing glutaric acid, the most water-soluble of these three saturated aliphatic dibasic acids, as the major component. Generally, the weight ratio of adipic acid:-glutaric acid: succinic acid is selected to be within the range of 1–3:1–8:1–5, and preferably within the range of 1–2:1–6:1–3. The organic acids provide moderate acidity to the cleaning compositions of present invention and thereby enhance cleaning performance, particularly removal of soap scum from tiles and other hard surfaces, with very little damage to the grout between the tiles and with reduced irritation to the skin of the user.

A third essential ingredient present in the liquid cleaning composition of the present invention is an acid-stable antimicrobial, germicidal or disinfectant compound comprising at least about 0.1% by weight of the composition. Suitable antimicrobial germicidal and disinfectant compounds are well known in the art and include chlorhexidine, acid stable germicidal quaternary ammonium compounds (e.g. Variquat 50 Mc marketed by Sherex or BTC 2125 M marketed by Onyx) glutaraldehyde, formaldehyde, and betaines. Minor amounts, up to about 2%, of isopropyl alcohol may also be included in the composition to enhance the antimicrobial effect, particularly against Pseudomonas. It will be obvious to those skilled in the art that useful antimicrobials may be cationic, nonionic or anionic as long as the compound selected is acid stable and does not interact with other components of the composition, maintaining germicidal activity without adversely affecting the cleaning properties of the composition.

The pH of the acidic liquid detergent composition is adjusted to maximize the antimicrobial effect of the disinfecting agent while maintaining effective cleaning of soap scum and oily soils. Generally, the pH is from about 2–4, preferably about 2.5–3. In addition to providing efficient cleaning, this pH range is less damaging to the cleaned surface and less irritating to the skin than the commercially available acidic cleaners.

Optionally, an acid-stable cationic or anionic soil releasing agent may be included in the composition in an amount of about 0.25% to 2% by weight, preferably 0.25–1% weight. The soil releasing agent must be substantive to the surface being cleaned at the pH of the liquid cleaning composition and acts to inhibit subsequent redeposition and/or adhesion of soils, particularly soap scum and mineral deposits, on the cleaned surface. Although the applicants do not wish to be bound by any theory of operation, it is believed that the cleaned surface is modified by the deposition of the soil releasing agent, which provides for easier removal of soils during subsequent cleanings. Compounds which promote surface hydration are believed to be the most efficient soil releasing agents for the present cleaning compositions.

The soil releasing agent may be cationic or anionic, selected to be acid-stable and compatible with the other components of the composition, especially the disinfectant. Compounds useful for their soil releasing properties include antistatic polymers consisting of recurring monomers of beta [trialkyl ammonium] ethyl methacrylate (wherein the alkyl group attached to the ammonium moiety may be ethyl or methyl) and hydrolyzed 1:1 styrene maleic anhydride copolymer (average molecular weight 1000–5000). The antistatic polymers useful as soil releasing agents in the present invention are derived from monomers having the following basic structure:

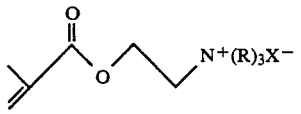

These antistatic compounds are poly beta-trialkyl ammonium ethyl methacrylates (herein abbreviated as AAEM) wherein the alkyl groups (R) may be methyl or ethyl or a mixture thereof, and X is an anion which may be a halide such as chloride, an alkyl sulfate such as methyl sulfate or lauryl sulfate or an ethoxylated alkyl sulfate or mixtures thereof.

A preferred antistatic polymer for use as a soil releasing agent in the present invention is poly beta [methyl diethyl ammonium] ethyl methacrylate methyl sulfate (herein abbreviated as MDAEM) which is derived from monomers having the following basic structure:

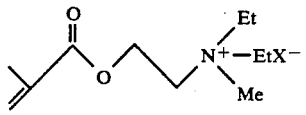

wherein Me is methyl, Et is ethyl and X is methyl sulfate. The molecular weight of the polymer is about 10,000–500,000.

MDAEM is available commercially as an opaque, moderately viscous emulsion having a pH of 6–8 and a specific gravity of 1. It is completely miscible in water. The active antistatic ingredients constitute approximately 15–20% by weight and the volatile ingredients constitute approximately 80–85% by weight of the commercial product, which is stable, will not decompose or polymerize, and is incompatible with oxidizing or reducing agents. Because sodium lauryl sulfate is present in the commercial preparation, the polymer is present as a 3:1 mixture of the methyl sulfate and lauryl sulfate forms. The inclusion of the soil-release agent MDAEM in the present novel acid disinfectant all-purpose liquid cleaning composition provides significantly enhanced soil removal on subsequent cleaning of pretreated surfaces. Thus, during recleaning of a previously cleaned surface, soil removal of soap scum from a hard surface such as bathroom tile or the like can be effected with significantly less effort as compared to the use of commercially available products.

The balance of the novel acidic disinfectant liquid cleaning composition is water, preferably distilled water, reduced by any optional ingredients which may be present. Generally, the proportion of water in the compositions is about 88% to 94% by weight of the composition. Those skilled in the art will readily appreciate that minor amounts of additional ingredients may be optionally present to provide cosmetically appealing products and increase consumer acceptability. Examples of such adjuvants include acid-stable coloring agents, fragrances, perfumes, viscosifiers, and pH adjusting agents such as 50% sodium hydroxide.

In final form, the all-purpose liquid detergents are homogeneous aqueous compositions which exhibit stability at both reduced and increased temperatures. More specifically, such compositions remain stable in the range of 5° C. to 40° C. The liquids are readily pourable and free flowing from any suitable container or may be sprayed from a pump-type sprayer.

The compositions are directly ready for use. Only minimal rinsing is needed and substantially no residue or streaks are left behind on the cleaned surface. Because the compositions are free of detergent builders such as alkali metal polyphosphates they are environmentally acceptable and provide a better "shine" on cleaned hard surfaces.

Typically, the inventive compositions are prepared simply by combining all of the ingredients in a suitable mixing vessel or container. Generally, the various ingredients can be added sequentially, or all at once, to form an aqueous solution of each or all of the essential ingredients. Preferably, when a fragrance is present, the fragrance is first dissolved in the water dispersible nonionic surfactant which is then added to the other ingredients in aqueous acid solution. When the surfactant/fragrance mixture is added to the aqueous acid solution containing the remaining ingredients, the solution may become slightly hazy. If a cationic disinfectant compound is added to the aqueous mixture, the fragrance becomes completely solubilized and the final mixture is clear as well as stable. The compositions may be prepared at room temperature.

In use, the compositions of this invention are applied to the surfaces to be cleaned with a cloth or sponge or by spraying onto ceramic or other surfaces which have been soiled by accumulations of insoluble soaps, mineral deposits, and oily soils. The cleaning compositions, without added thickeners, are of about the viscosity of water but may be thinner than water. The material will usually be allowed to remain on the surface to be cleaned for a period from 10 seconds to 5 or 10 minutes, but preferably such contact time will be from about 30 seconds to five minutes or from 1 to 3 minutes. The liquid cleaner composition may then be removed either by wiping or rinsing with water. These compositions leave substantially no spots or streaks whether or not they are rinsed from the cleaned surface.

The compositions of the invention provide enhanced cleaning with less acidity as compared to commercially available cleaners and, therefore, are less damaging to the cleaned surface. Microscopic examinations of the grout between tiles shows no erosion or other deterioration after cleaning as compared to commonly available cleaning compositions.

The following examples illustrate the acidic liquid disinfectant cleaning compositions of the described invention. Unless otherwise specified, all percentages are by weight. The exemplified compositions are illustrative only and do not limit the scope of the invention.

EXAMPLE 1

| INGREDIENT | WEIGHT % |
|---|---|
| DAGS[1] | 5.0 |
| Neodol 91-8[2] | 1.5 |
| Neodol 91-2.5[3] | 0.7 |
| BTC 2125M[4] (50% solution) | 0.4 |
| Water | QS |
| pH 2.5 | |

1. Dicarboxylic acids mixture of 11.6% adipic, 57.5% glutaric and 27% succinic acids in the form of water soluble white flakes having the formula HOOC—$(CH_2)_{2-4}$—COOH marketed by Dupont.
2. $C_9$–$C_{11}$ alcohol EO8:1 marketed by Shell Oil Co.
3. $C_9$–$C_{11}$ alcohol EO2.5:1 marketed by Shell Oil Co.
4. Benzalkonium chloride $[C_6H_5CH_2N(CH_3)_2C_{8-18}$ alkylmixture$]^+Cl^-$ marketed by Onyx.

This composition is prepared by adding DAGS to the formula amount of water to form an acidic aqueous solution, to which is added either simultaneously or sequentially the Neodols and the BTC. If necessary, 50% sodium hydroxide is added to adjust the pH to 2.5. A clear stable aqueous composition is formed having improved cleaning and disinfecting properties.

The acidic disinfectant cleaning composition of Example 1 was tested comparatively against commercially available cleaning compositions for cleaning performance in a soap scum removal test. Four comparative tests were conducted, each consisting of the composition of Example 1 against a single commercial cleaner. Etched white ceramic tiles (4.25 in.×4.25 in.) were sprayed with a 250 g/1 solution of $CaCl_2 \cdot 2H_2O$ followed by a red dyed 5% sodium oleate solution. After permitting the tiles to dry for one hour at 30° C., the soiling procedure was repeated. The soil so produced was uniform and reproducible within acceptable limits. After the second soil layer was dried, the tiles were mounted in a Gardner Abrasion Tester (Pacific Scientific Gardner—Neotec Instrument Div.) equipped with two cellulose sponges measuring 5 cm×5 cm×5 cm. Three grams of the liquid cleaning composition being tested were pipetted onto the sponge holding 5 gms water, and the soiled tiles were subjected to 20 back and forth strokes of the sponge (abrader cycles). A reflectometer was used to measure the reflectance before and after the 20 abrader cycles and the % soil removal was determined. The results obtained are set forth in Table 1 below:

TABLE 1

PERCENT SOAP SCUM REMOVAL OF COMPOSITION OF THE INVENTION VERSUS COMMERCIAL CLEANING COMPOSITIONS

| Test No. | Example 1 pH 2.5 | Dow Disinfectant Bathroom Cleaner[1] pH 12 | Lysol Disinfectant Basin, Tub & Tile[2] Cleaner pH 12 | Lime Away[3] pH 0.5 | Scrub Free[4] pH 1.0 |
|---|---|---|---|---|---|
| 1 | 52% | 15% | — | — | — |
| 2 | 49% | — | 11% | — | — |
| 3 | 47% | — | — | 65% | — |
| 4 | 69% | — | — | — | 80% |

[1]Dow Consumer Products, Inc.
[2]Lehn & Fink Products, Division of Sterling Drug, Inc.
[3]Benckiser Consumer Products, Inc.
[4]Benckiser Consumer Products, Inc.

The Standard Deviation of the above results is plus or minus 5 soil removal percent units.

The above results demonstrate that the acidic cleaning composition of the present invention is markedly superior to commercially available alkaline compositions in cleaning efficacy. As compared to commercial acidic cleaners, the present composition provides slightly inferior cleaning of soap scum but is considerably less acidic than these commercial formulas and therefore less irritating to the skin of the user. Moreover, the composition of the invention has disinfectant properties.

EXAMPLE 2

Formulas A and B were prepared as shown below:

| INGREDIENT | WEIGHT % |
|---|---|
| FORMULA A: | |
| DAGS | 5.0 |
| Neodol 91-8 | 1.5 |
| Neodol 91-2.5 | 0.7 |
| BTC 2125M (50% solution) | 0.4 |
| Perfume | 0.2 |
| Water | QS |
| FORMULA B: | |
| DAGS | 5.0 |
| Neodol 91-8 | 1.5 |
| Neodol 91-2.5 | 0.7 |
| BTC 2125M (50% solution) | 0.4 |
| Perfume | 0.2 |
| MDAEM[1] (15-20% solution) | 1.4 |
| Water | QS |

[1]Commercially available preparation consisting of 15-20% polymer, 5-10% isopropanol, 3-5% N-octanol, 3-5% sodium acetate, 1-3% terpene hydrocarbons and 3-5% sodium lauryl sulfate.

Formula A was prepared by separately dissolving the fragrance in Neodol 91-2.5 and adding Neodol 91-8 to form a Neodol-fragrance mixture. An acid water solution was made by dissolving DAGS in the formula amount of water to which was added the perfume-Neodol mixture. A slightly hazy solution was formed. The benzalkonium chloride was added to the acid water solution which clarified the haziness, and the pH was adjusted to a pH of 2.5, as needed, by the addition of a 50% sodium hydroxide solution.

Formula B was prepared in the same way as Formula A except that MDAEM was added to the acidic aqueous solution containing perfume, BTC and the Neodols. Optionally, 2.0% isopropanol may be included in Formula B for cosmetic purposes, to clarify the slightly hazy composition which results when MDAEM is added to the formulation. Isopropanol does not interfere with the cleaning performance of the composition and other low molecular weight alcohols may be substituted for isopropanol for purposes of producing a clear composition containing MDAEM. Inclusion of about 2.0% of a low molecular weight alcohol, particularly isopropanol, provides the additional advantage to the composition of enhancing the antimicrobial properties of the disinfectant cleaner.

Formula A and Formula B above were compared for cleaning performance in the soap scum removal test set forth in Example 1, using 20 abrader cycles. The results are presented in Table 2:

TABLE 2

| PERCENT SOAP SCUM REMOVAL FORMULA | |
|---|---|
| A | B |
| 67% | 65% |

These results demonstrate that inclusion of the soil-releasing agent MDAEM does not interfere with the first-time cleaning performance of the acidic liquid disinfectant detergent composition of the present invention.

EXAMPLE 3

Formulas C and D were prepared as shown below:

| INGREDIENT | WEIGHT % |
|---|---|
| FORMULA C: | |
| DAGS | 5.0 |
| Neodol 91-8 | 1.5 |
| Neodol 91-2.5 | 0.7 |
| Chlorhexidine | 0.2 |
| Water | QS |
| FORMULA D: | |
| DAGS | 5.0 |
| Neodol 91-8 | 1.5 |
| Neodol 91-2.5 | 0.7 |
| Chlorhexidine | 0.2 |
| MDAEM (15-20% solution) | 2.3 |
| Water | QS |

Formulas C and D were prepared as described in Example 2 for the corresponding compositions. The results of the soap scum removal tests for Formulas C and D are given in Table 3 below:

TABLE 3

| PERCENT SOAP SCUM REMOVAL | FORMULA | |
|---|---|---|
| | C | D |
| Test #1 | 49% | 60% |
| Test #2 | 52% | 65% |

EXAMPLE 4

Formulas E and F were prepared as shown below:

| Ingredient | Weight % |
|---|---|
| FORMULA E: | |
| DAGS | 5.0 |
| Neodol 91-8 | 1.5 |
| Neodol 91-2.5 | 0.7 |
| Variquat 50 MC (50% solution) | 0.4 |
| Water | QS |
| FORMULA F: | |
| DAGS | 5.0 |
| Neodol 91-8 | 1.5 |
| Neodol 91-2.5 | 0.7 |
| Variquat 50 MC (50% solution) | 0.4 |
| MDAEM (15-20% solution) | 2.3 |
| Water | QS |

To test for ease of recleaning, ceramic tiles were cleaned with Formulas E and F under normal ambient conditions of temperature and humidity, rinsed with distilled water and patted dry. The tiles were then soiled as described in the soap scum removal test of Example 1 and recleaned, also under normal ambient conditions of temperature and humidity, using a non-acidic conventional cleaning composition comprised of an aqueous solution of 1:1 by weight Neodol 91-6 and Neodol 91-2.5. Ten abrader cycles were used for the recleaning step, which represents one-half the number of abrader cycles used in the first-cleaning tests described in Examples 1-3. The results of this recleaning test are given in Table 4 below:

TABLE 4

| PERCENT SOAP SCUM REMOVAL ON RECLEANING PRETREATMENT FORMULA | |
|---|---|
| E | F |
| 24% | 95% |

As shown in Table 4, pretreatment of the test tiles with the inventive composition F containing a soil releasing agent provided 95% soil removal with 10 abrader cycles. Pretreatment with formula E without the soil releasing agent provided only 24% soil removal with an equivalent amount of scrubbing in the recleaning test. These results demonstrate that ease of recleaning is significantly enhanced by inclusion of the soil releasing agent in the inventive composition.

Ease of recleaning was found to improve as humidity levels were increased above about 35% humidity.

What is claimed is:

1. A stable acidic disinfectant all-purpose liquid cleaning composition comprising by weight:

(a) about 0.5-4% of a mixture of acid stable nonionic surfactants, said mixture consisting essentially of a water soluble nonionic surfactant and a water dispersible nonionic surfactant in a weight ratio of water-soluble to water-dispersible surfactant of from about 4:1 to 4:3;

(b) about 3–7% of an organic acid selected from the group consisting of lower aliphatic monocarboxylic acids, lower aliphatic dicarboxylic acids and mixtures thereof;

(c) at least 0.1% of an acid stable antimicrobial compound;

(d) from about 0–2% of an acid-stable cationic or anionic soil releasing agent; and, (e) the balance water, said liquid cleaning composition having a pH of about 2–4, wherein the water soluble nonionic surfactant is selected from the group consisting of acid-stable nonionic surfactants having a hydrophilic/lipophilic balance (HLB) of at least about 11 and the water dispersible nonionic surfactant is selected from the group consisting of acid stable nonionic surfactants having a hydrophilic/lipophilic balance of abut 7–10.

2. The cleaning composition according to claim 1 wherein the acid stable nonionic surfactants are selected from the group consisting of linear fatty alcohol ethoxylates.

3. The cleaning composition according to claim 1 wherein the mixture of acid stable nonionic surfactants comprises about 2–4% by weight of the composition.

4. The cleaning composition according to claim 1 wherein the ratio of water soluble to water dispersible nonionic surfactant is 3:1 to 3:2.

5. The cleaning composition according to claim 1 wherein the pH of the composition is 2.5–3.

6. The cleaning composition according to claim 1 wherein the antimicrobial agent is selected from the group consisting of acid stable antimicrobial quaternary ammonium compounds.

7. The cleaning composition according to claim 1 wherein the antimicrobial agent is chlorhexidine.

8. The cleaning composition according to claim 1 wherein the organic acid is selected from the group consisting of $C_{2-6}$ alkyl and alkenyl monobasic acids, $C_{2-6}$ alkyl and alkenyl dibasic acids and mixtures thereof.

9. The cleaning composition according to claim 8 wherein the organic acid is a mixture of lower aliphatic dicarboxylic acids comprising about 3–5% by weight of the composition.

10. The cleaning composition according to claim 8 wherein the organic acid mixture contains adipic, glutaric and succinic acids in a weight ratio of 1–3:1–8:1–5 respectively.

11. The cleaning composition according to claim 1 wherein the acid mixture comprises hydroxy acetic acid.

12. The cleaning composition according to claim 1 wherein the antimicrobial agent is benzalkonium chloride.

13. The cleaning composition according to claim 1 wherein the acid stable nonionic surfactants are selected from the group consisting of alkanol ethoxylates, alcohol propoxylates, alkyl phenol ethoxylates and higher alcohols condensed with a mixture of ethylene oxide and propylene oxide having a terminal ethoxylate group.

14. The cleaning composition according to claim 2 wherein the mixture of nonionic surfactants consists essentially of $C_{9-11}$ alcohol EO 8:1 and $C_{9-11}$ alcohol EO 2.5:1.

15. The cleaning composition according to claim 14 wherein the $C_{9-11}$ alcohol EO 8:1 and $C_{9-11}$ alcohol EO 2.5:1 comprise about 1.5% and about 0.7% of the composition by weight, respectively.

16. The cleaning composition according to claim 1 comprising 0.25–1% of an acid stable cationic or anionic soil releasing agent selected from the group consisting of poly beta trialkyl ammonium ethyl methacrylates having ethyl or methyl groups attached to the ammonium moiety and hydrolyze 1:1 styrene-maleic anhydride polymers (average molecular weight 1000–5000).

17. The cleaning composition according to claim 8 which comprises by weight 5% of a mixture of dicarboxylic acids, said mixture consisting essentially of adipic, glutaric and succinic acids, 0.2% of an acid stable antimicrobial benzyl $C_{12}$–$C_{18}$ alkyl dimethyl quaternary ammonium compound, about 0.4% of poly beta [methyl diethyl ammonium] ethyl methacrylate methyl sulfate having a molecular weight of 10,000–500,000, and about 2.5% of an acid stable mixture of nonionic surfactants consisting essentially of $C_{9-11}$ alcohol EO 8:1 and $C_{9-11}$ alcohol EO 2.5:1 in a weight ratio of about 2:1 of the first aforementioned nonionic surfactant having a molar ratio of ethylene oxide to alcohol of 8:1 relative to the second aforementioned nonionic surfactant having a molar ratio of ethylene oxide to alcohol of 2.5:1.

18. A method of simultaneously disinfecting and cleaning a hard surface comprising contacting said surface with the composition of claim 1 and wiping said surface to remove soil.

19. The method according to claim 18 wherein the composition of claim 1 contains a soil releasing agent which treats the surface to be cleaned such that removal of soil from said surface during a second recleaning step is enhanced.

20. The method according to claim 18 wherein the composition of claim 1 comprises:

(a) about 2–4% of a mixture of acid stable nonionic surfactants, said mixture consisting essentially of a water soluble nonionic surfactant and a water dispersible nonionic surfactant in a weight ratio of water soluble to water dispersible surfactant of from about 3:1 to 3:2;

(b) about 3–5% of an organic acid selected from the group consisting of lower aliphatic monocarboxylic acids, lower aliphatic dicarboxylic acids and mixtures thereof;

(c) at least 0.1% of an acid stable antimicrobial compound;

(d) from about 0.25–1% of an acid stable cationic or anionic soil releasing agent; and, (e) the balance water, said liquid cleaning composition having a pH of about 2.5–3.

* * * * *